US006720668B2

(12) United States Patent
Niimi

(10) Patent No.: US 6,720,668 B2
(45) Date of Patent: Apr. 13, 2004

(54) STARTER HAVING MEANS FOR RESTRICTING PINION ROTATION

(75) Inventor: Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 62 days.

(21) Appl. No.: 10/201,714

(22) Filed: Jul. 24, 2002

(65) Prior Publication Data

US 2003/0067172 A1 Apr. 10, 2003

(30) Foreign Application Priority Data

Oct. 5, 2001 (JP) ..... 2001-309337

(51) Int. Cl.[7] ..... F02N 11/00
(52) U.S. Cl. ..... 290/38 R; 74/6
(58) Field of Search ..... 290/38 R, 38 A, 290/48; 74/6, 7 B; 310/75 D

(56) References Cited

U.S. PATENT DOCUMENTS 5,471,890 A * 12/1995 Shiga et al. ..... 74/7 E
5,610,445 A * 3/1997 Shiga et al. ..... 290/38 R
5,767,585 A * 6/1998 Shiga et al. ..... 290/38 R
5,789,821 A * 8/1998 Shiga et al. ..... 290/38 R
5,814,896 A 9/1998 Araki ..... 290/38 R
5,945,755 A * 8/1999 Ohmi et al. ..... 310/75 R
6,011,316 A * 1/2000 Niimi ..... 290/38 R
6,114,772 A * 9/2000 Araki et al. ..... 290/48

* cited by examiner

*Primary Examiner*—Nicholas Ponomarenko
(74) *Attorney, Agent, or Firm*—Oliff & Berridge, PLC

(57) ABSTRACT

A starter for cranking an engine has a pinion gear coupled via a helical spline to an output shaft driven by an electric motor. The pinion gear is pushed forward to engage with a ring gear of the engine by restricting rotation of the pinion. A rod member is coupled to one of depressions formed on an outer periphery of an annular member integrally formed with the pinion gear to restrict the rotation of the pinion gear. Rollers are disposed between the neighboring two depressions to reduce abrasive force between the rod member and the outer periphery of the annular member under a situation where the pinion gear is forcibly rotated by the electric motor while its rotation is restricted. The rod member coupled to the depression rolls over the rollers to be coupled to other depressions to allow such a forcible rotation of the pinion gear, thereby alleviating the abrasive force.

5 Claims, 4 Drawing Sheets

STARTER HAVING MEANS FOR RESTRICTING PINION ROTATION

CROSS-REFERENCE TO RELATED APPLICATION

This application is based upon and claims benefit of priority of Japanese Patent Application No. 2001-309337 filed on Oct. 5, 2001, the content of which is incorporated herein by reference.

BACKGROUND OF THE INVENTION

1. Field of the Invention

The present invention relates to a starter for cranking an internal combustion engine, in which a pinion is engaged with a ring gear of the engine by pushing forward the pinion by a helical spline while restricting rotation of the pinion.

2. Description of Related Art

An example of the starter of this type is disclosed in JP-A-9-49476. This starter includes a pinion coupled with an output shaft via a helical spline formed on the output shaft and a member for restricting rotation of the pinion to push forward the pinion by the helical spline. The pinion, rotation of which is restricted by the restricting member, is released after its engagement with ring gear is established, thereby to transmit a rotational torque of an electric motor to a ring gear of the engine.

In a process of cranking up an engine, there is a possibility that a driver inadvertently restarts the starter after the engine is already started. In this case, the pinion cannot engage with the ring gear because the ring gear is rotating at a high speed. Accordingly, the pinion is forcibly rotated while its rotation is restricted by the restricting member. For allowing the pinion rotation, in the conventional starter described in the above publication, the restricting member coupling with one of plural depressions formed on an outer periphery of an annular member is forcibly and repeatedly moved from one depression to other depressions. In this movement of the restricting member, a high abrasive force is generated between the restricting member and projections formed between the depressions. Therefore, abrasion wear occurs on both of the restricting member and the projections. As the abrasion wear proceeds, the restricting member becomes unable to perform its function for restricting the pinion rotation, and thereby an operating life of the starter is shortened.

SUMMARY OF THE INVENTION

The present invention has been made in view of the above-mentioned problem, and an object of the present invention is to provide an improved starter having a long operating life by reducing the abrasive force imposed on the member for restricting rotation of the pinion.

The starter for cranking an internal combustion engine includes an electric motor, an output shaft driven by the electric motor and a pinion coupled to the output shaft via a helical spline. The pinion is composed of a pinion gear that engages with a ring gear of the engine to crank up the engine and an annular member integrally formed with the pinion gear. The annular member has an outer periphery, a diameter of which is larger than that of the pinion gear. Plural depressions are formed on the outer periphery of the annular member, and a rod member is engaged with one of the depressions to restrict rotation of the pinion.

The pinion coupled to the output shaft via the helical spline formed on the output shaft is pushed forward to a position engaging with the ring gear according to rotation of the output shaft. Rotation of the pinion is restricted to obtain a thrust force to push forward the pinion. After the pinion engagement with the ring gear is established, the restriction of pinion rotation is removed by separating the rod member from the depression of the annular member. Then, the engine is cranked up by a rotational torque of the pinion gear driven by the electric motor. After the engine is cranked up, the pinion is returned to its original position by a biasing force of a return spring.

Under certain situations, e.g., when the starter motor is inadvertently restarted after the engine has been cranked up, the pinion is forcibly rotated by the electric motor while its rotation is restricted. In such a case, the rod member engaging with one of the depressions has to move to other depressions overriding a projected portion between neighboring two depressions to allow the pinion to rotate. In this case, a high abrasive force is generated between the rod member and the outer periphery of the annular member, causing abrasion wear of both members.

To reduce such abrasive force, rollers are disposed between neighboring two depressions. The rod member rolls over the rollers when the restricted pinion is forcibly rotated, thereby reducing the abrasion wear of both the rod member and the annular member. An operating life of the starter is prolonged by reducing the abrasion wear.

Alternatively, instead of disposing the rollers between the depressions, the rod member may be covered with a rolling sleeve which similarly reduces the abrasive force between the rod member and the annular member. Both of the rollers and the rolling sleeve may be used to further reduce the abrasive force.

Other objects and features of the present invention will become more readily apparent from a better understanding of the preferred embodiments described below with reference to the following drawings.

Figure 1A:
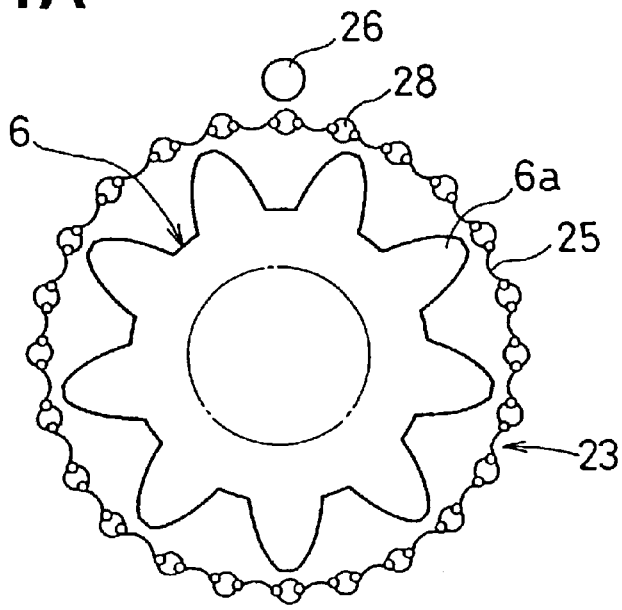
FIG. 1A is a front view showing a pinion and means for restricting rotation of the pinion, as a first embodiment of the present invention.

DETAILED DESCRIPTION OF THE PREFERRED EMBODIMENTS (First Embodiment)

First, referring to FIG. 4, an entire structure of a starter will be described. The starter 1 is composed of: an electric motor 2 generating a rotational torque; an electromagnetic switch 3 for switching on and off electric current supplied to the electric motor 2; an output shaft 5 disposed coaxially with an armature shaft 9*a*; a speed reduction device for reducing rotational speed of the electric motor 2; an one-way clutch (a known type, not shown in FIG. 4) disposed between the speed reduction device and the output shaft 5; a pinion 6 coupled with the output shaft 5; and means for restricting rotation of the pinion 6. The restricting means will be described later in detail.

The electric motor 2 is a known type of a direct current motor having a yoke 7, a field permanent magnet 8, an armature 9, brushes 10 and other associated components. Electric current is supplied to the armature 9 through the brushes 10 when a current supply circuit is closed by the electromagnetic switch 3. The output shaft 5 is rotatably supported at its front end by a bearing 11 disposed in a front housing 12 and at its rear end by a bearing (not shown) disposed in a center case 13. A helical spline 5*a* is formed on the output shaft 5. The center case 13 is interposed between the front housing 12 and the yoke 7 of the electric motor 2 and covers an outside of the speed reduction device.

The electromagnetic switch 3 is disposed at the rear side of the starter and is covered with a rear end frame 14. The electromagnetic switch 3 includes a coil 15 energized by current supplied upon closing an ignition switch (not shown), a plunger 16 slidably disposed inside the coil 15, and a movable contact 17 connected to the plunger 16. When the plunger 16 is pulled by a magnetic force of the coil 15, the movable contact 17 carried by the plunger 16 abuts a pair of stationary contacts 18 fixed to the rear end frame 14 thereby to close the stationary contacts 18. Upon closing the stationary contacts 18, electric current is supplied to the electric motor 2.

The speed reduction device is a planetary gear speed reduction device composed of: a sun gear 19 formed at a front end of the armature shaft 9*a*; a ring-shaped internal gear 20; and plural planetary gears 21 engaging with both of the sun gear 19 and the internal gear 20. As the sun gear 19 is rotated by the armature 9, the planetary gears 21 rotate around their own axes and at the same time orbit around the sun gear 19. The orbital rotation speed of the planetary gears 21 is slower than the rotational speed of the armature 9. That is, the rotational speed of the armature 9 is reduced by the speed reduction device and is transmitted to the one-way clutch.

The pinion 6 has a pinion gear 6*a* (shown in FIGS. 5A and 5B) which engages with a ring gear of an engine (not shown) to crank up the engine. The pinion 6 is coupled to the output shaft 5 via a helical spline 5*a* formed on the output shaft 5. The pinion 6 is pushed forward along the helical spline 5*a* and is returned by a biasing force of a spring 22.

Figure 1B:
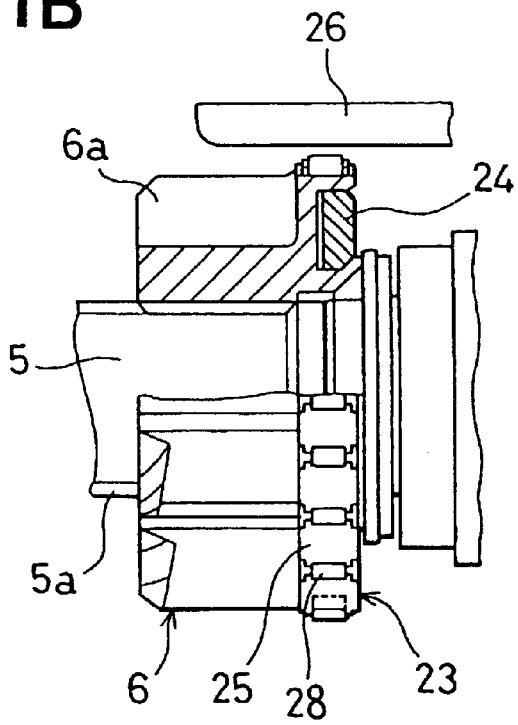
FIG. 1B is a side view showing the pinion and the restricting means shown in FIG. 1A.

Now, referring to FIGS. 1A–3, means for restricting rotation of the pinion 6 will be described. As shown in FIGS. 1A and 1B, the restricting means is composed of an annular member 23 formed integrally with the pinion 6, a disc 24 rotatably connected to a rear side of the annular member 23, and a rod member 26. An outer diameter of the annular member 23 is made larger than an outer diameter of the pinion gear 6*a*. Plural arc-shaped depressions 25 are formed on the outer periphery of the annular member 23, and the rod member 26 engages with one of the depressions 25 to restrict the pinion rotation.

Figure 2:
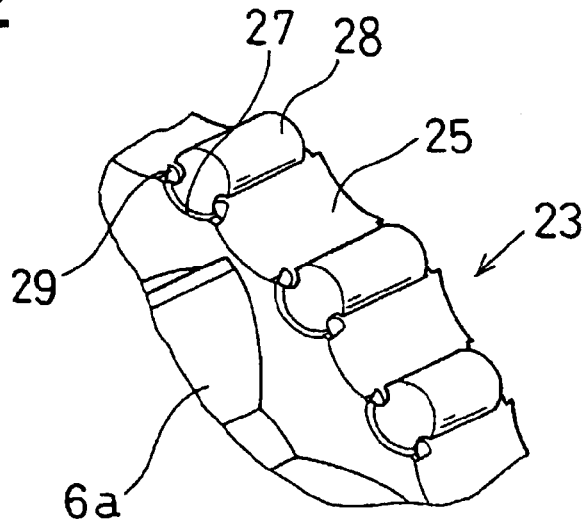
FIG. 2 is a perspective view showing an annular member having arc-shaped depressions that engage with a rod member for restricting rotation of the pinion.
Figure 3:
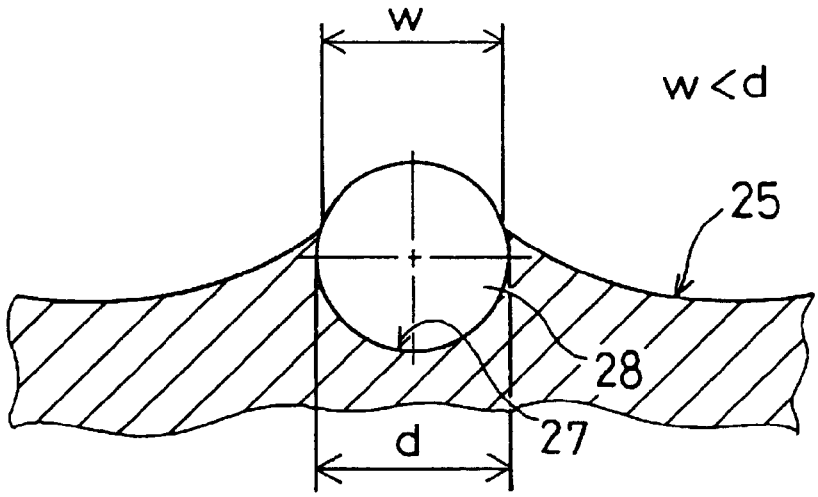
FIG. 3 is a cross-sectional view showing part of the annular member in an enlarged scale.

As shown in FIGS. 2 and 3, a semi-spherical roller space 27 is formed between neighboring depressions 25, and a roller 28 is rotatably held in the roller space 27. As shown in FIG. 3, an opening width "w" of the roller space 27 is made smaller than a diameter "d" of the roller 28 to retain the roller 28 in the roller space 27 when a centrifugal force is applied thereto according to rotation of the annular member 23. As shown in FIG. 2, staked portions 29 are formed at both axial sides of the roller 28 to retain the roller 28 in its axial direction.

Figure 4:
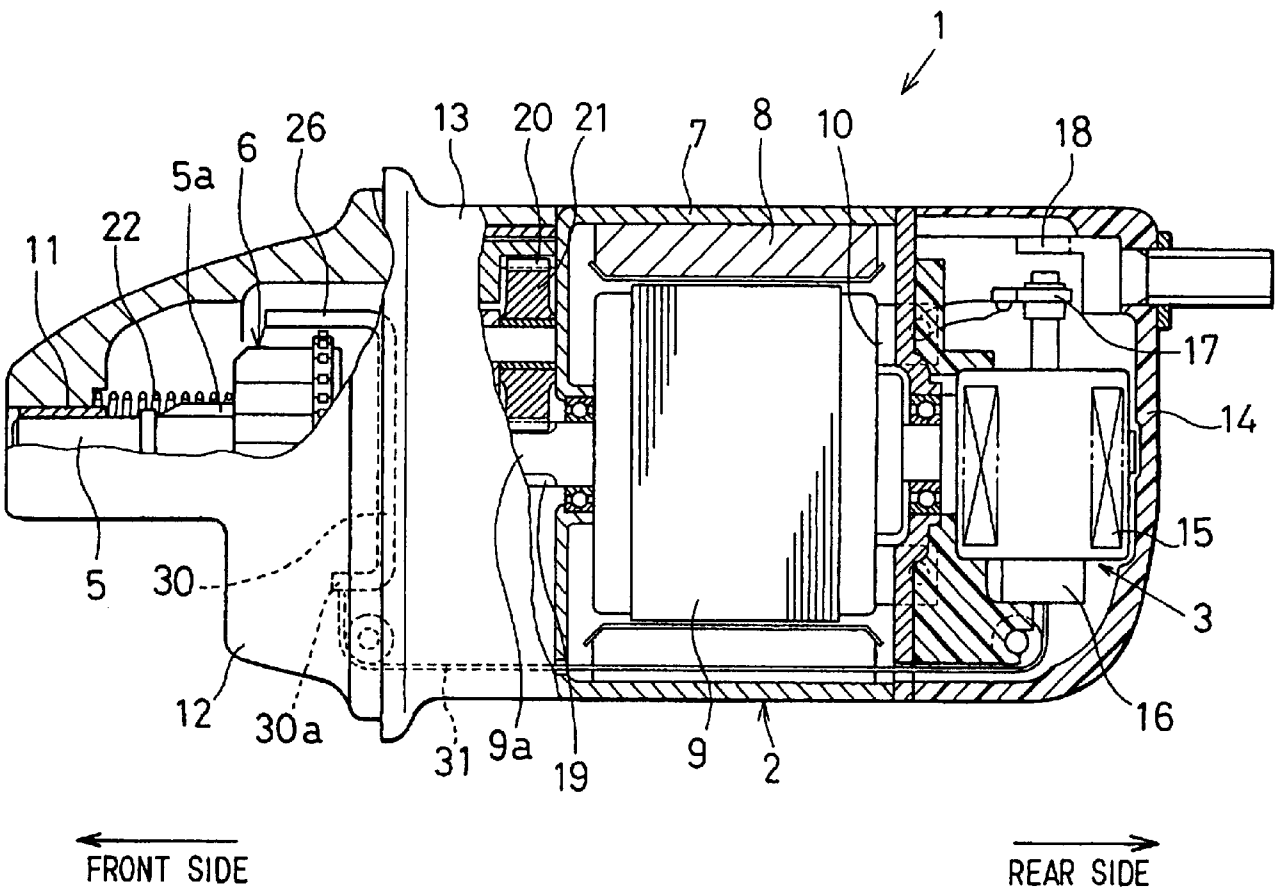
FIG. 4 is a cross-sectional view showing an entire structure of a starter.

The rod member 26 engaging with the depressions 25 is formed by bending one end of a circular rod 30, as shown in FIG. 4. The rod member 26 is positioned outside of the annular member 23 when it is not engaged with the depression 25 of the annular member 23. The rod member 26 is brought to a position to engage with the depression 25 by a mechanism described below. The rod member 26 is released from the depression 25 after the pinion gear 6*a* is pushed forward to a position where the pinion gear 6*a* completely engages with the ring gear. The axial length of the rod member 26 is made to cover the axial movement of the pinion 6.

The circular rod 30, as shown in FIG. 4, is disposed in the starter 1, so that it is movable up and down in the radial direction of the pinion 6 while its movement in the axial direction is restricted. The other end 30*a* of the circular rod 30 is connected to the plunger 16 of the electromagnetic switch 3 with a wire 31, and the circular rod 30 is biased upward by a return spring (not shown). When the plunger 16 is pulled upward by the coil 15, the circular rod 30 is pulled down by the wire 31 against the biasing force of the return spring. When the pulling force of the coil 15 disappears upon termination of current supply to the coil 15, the circular rod 30 is returned to its original position by the biasing force of the return spring.

Operation of the pinion rotation restricting means described above will be explained. Upon turning on the key switch, the coil 15 is energized and the plunger 16 is pulled in by the coil 15. The circular rod 30 is pulled down by the wire 31 connected to the plunger 16, and thereby the rod member 26 of the circular rod 30 engages with one of the depressions 25 formed on the outer periphery of the annular member 23 to restrict rotation of the pinion 6. Then, the movable contact 17 carried by the plunger 16 abuts the stationary contacts 18, thereby forming a circuit for supplying current to the armature 9 of the electric motor 2.

When the armature 9 rotates, the rotational torque of the armature 9 is transmitted to the output shaft 9 via the speed reduction device and the one-way clutch. The rotational speed of the armature 9 is reduced by the speed reduction device. As the output shaft 5 rotates, the pinion 6 coupled to the output shaft 5 via the helical spline 5*a* is pushed forward by a thrust force generated by restricting the rotation of the pinion 6. The pinion 6, rotation of which is restricted, is pushed forward until it abuts an end surface of the ring gear. Because the axial movement of the pinion 6 is once stopped by abutting the ring gear, the pinion 6 coupled to the output shaft 5 via the helical spline 5*a* is forcibly rotated by the output shaft 5 against a resilient force of the circular rod 30. As the pinion gear 6*a* is forcibly rotated to a position where the pinion gear 6*a* is able to engage with the ring gear, the pinion 6 moves forward again until the pinion gear 6*a* completely engages with the ring gear.

When the complete engagement is established, the rod member 26 is separated from the depression 25 of the annular member 23 thereby to release the rotation restriction of the pinion 6. As the pinion 6 is released from the restriction, the pinion gear 6*a* engaging with the ring gear is rotated by the output shaft 5 thereby to crank up the engine. The rod member 26 separated from the depression is positioned behind the rear surface of the disc 24 to restrict a backward movement of the pinion 6.

Upon turning off the key switch after the engine is cranked up, current supply to the coil 15 is terminated and the pulling force of the coil 15 disappears. The plunger 16 returns to its original position (the position shown in FIG. 4) by a biasing force of a return spring (not shown). The movable contact 17 is separated from the stationary contacts 18 thereby to terminate current supply to the armature 9 and to stop the armature rotation. As the plunger 16 returns to its original position, the tension applied to the wire 31 from the plunger 16 is released, and the circular rod 30 connected to the wire 31 returns to its original position (the position shown in FIG. 4) by the biasing force of the return spring. The rod member 26 positioned behind the disc 24 also returns to its original position, removing the restriction of backward movement of the pinion 6. The pinion 6 moves backward and returns to its original position by the biasing force of the spring 22.

The following advantages are attained in the embodiment described above. If a driver inadvertently restarts the starter 1 after the engine has been cranked up, the pinion 6 is forcibly rotated while its rotation is restricted by the rod member 26 because the pinion gear 6*a* cannot engage with the ring gear which is rotating at a high speed. In this case, the rod member 26 coupled to one of the depressions 25 is forcibly separated from the depression and coupled with other depressions one by one to allow the pinion 6 to rotate. Since rollers 28 are disposed between the depressions 25, as shown in FIG. 2, the rod member 26 rolls over the rollers 28 each time it moves from one depression 25 to another one. The abrasive force between the rod member 26 and the outer periphery of the annular member 23 is considerably reduced by the freely rotatable rollers 28. Thus, the abrasion wear is alleviated, and the operating life of the starter 1 is prolonged.

The forcible rotation of the restricted pinion 6 may occur under other situations than the situation described above. For example, when the pinion 6, while its rotation is restricted by the rod member 26, is forcibly rotated to the position where the pinion gear 6*a* is able to engage the ring gear after the pinion 6 abuts the ring gear, the rod member 26 may roll over the rollers 28 to allow the forcible rotation of the pinion 6. In this case, too, the abrasion of rod member 26 against the outer periphery of the annular member 23 is alleviated by the freely rotatable rollers 28.

(Second Embodiment)

A second embodiment of the present invention will be described with reference to FIGS. 5A and 5B. In this embodiment, the rollers 28 disposed between neighboring depressions 25 in the first embodiment are eliminated, and instead, a rolling sleeve 32 is disposed to cover the rod member 26. As shown in FIG. 5B, the rod member 26 is inserted into the rolling sleeve 32 so that the rolling sleeve 32 is rotatable relative to the rod member 26. The rolling sleeve 32 is held not to drop off from the rod member 26 by a staked portion 26*a* formed at a free end of the rod member 26.

Figure 5A:
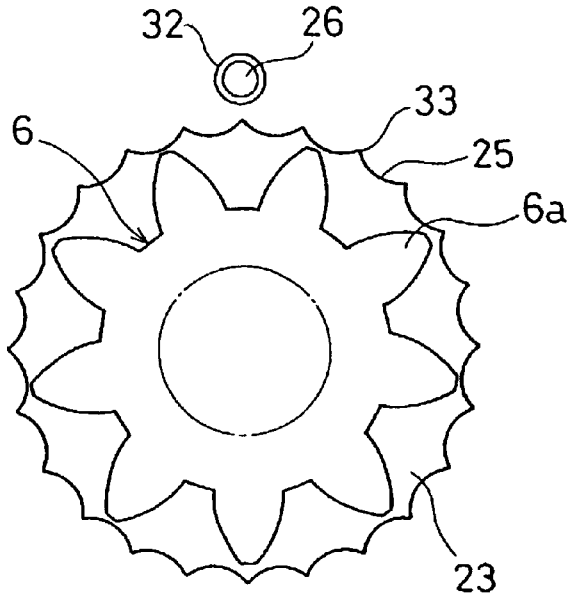
FIG. 5A is a front view showing a pinion and means for restricting rotation of the pinion, as a second embodiment of the present invention.
Figure 5B:
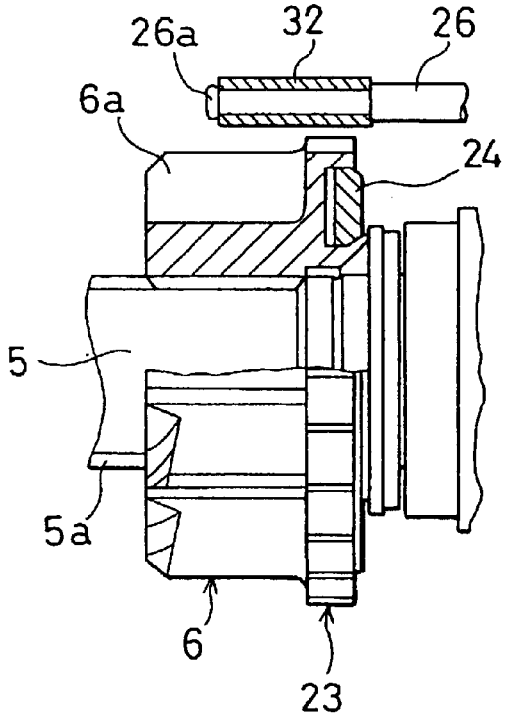
FIG. 5B is a side view showing the pinion and the restricting means shown in FIG. 5A.

On the outer periphery of the annular member 23, depressions 25 and the projections 33 are alternately formed, as shown in FIG. 5A. If a driver inadvertently restarts the starter 1 after the engine has been cranked up, the pinion 6 connected to the annular member 23, rotation of which is restricted by the rod member 23, is forcibly rotated. Under this situation, the rod member 23 covered by the rolling sleeve 32 can roll over the projections 33 to allow the rotaton of the pinion 6 in the similar manner as in the first embodiment. Accordingly, abrasive force between the rod member 26 and the projections 33 of the annular member 23 is alleviated.

(Other Modifications)

The present invention is not limited to the embodiments described above, but it may be variously modified. For example, both of the rollers 28 used in the first embodiment and the rolling sleeve 32 used in the second embodiment may be used together in order to enhance their function to reduce the abrasive force. The rollers 28 and the rolling sleeve 32 may be made of high or intermediate carbon steel and hardened by heat treatment, or may be made of a sintered metallic material. An amount of abrasive wear of the rollers 28 and the rolling sleeve 32 can be further reduced by hardening their surface. Though a structure in which only the pinion 6 moves on the output shaft 5 is shown in the above embodiments, it is also possible to use a pinion that moves together with a one-way clutch. In this case, the annular member 23 may be formed on the clutch.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A starter for cranking an internal combustion engine, the starter comprising:

an electric motor;

an output shaft adapted to be rotated by the electric motor;

a pinion having a pinion gear, the pinion being adapted to slidably move forward on the output shaft to bring the pinion gear into engagement with a ring gear of the engine;

means for restricting rotation of the pinion before the pinion gear engages with the ring gear; and a helical spline formed on the output shaft, the helical spline giving a thrust force to move forward the pinion, rotation of which is restricted by the restricting means, when the output shaft is rotated by the electric motor; wherein the restricting means comprises:

an annular member connected to the pinion, the annular member having a plurality of arc-shaped depressions formed on an outer periphery thereof;

a rod member engaging with one of the depressions to restrict the pinion rotation; and means for reducing abrasive force between the rod member and the annular member, when the rod member engaging with one of the depressions is forcibly disengaged from the depression and engaged with other depressions by a rotational torque applied to the pinion from the output shaft, the abrasive force reducing means being disposed on either the annular member or the rod member.

2. The starter as in claim 1, wherein:

the abrasive force reducing means is a rotating member that rotates to reduce the abrasive force between the rod member and the annular member.

3. The starter as in claim 2, wherein:

the rotating member is disposed on both the annular member and the rod member, and a surface of the rotating member is hardened to reduce abrasion wear thereof.

4. The starter as in claim 1, wherein:

the abrasive force reducing means is a plurality of rollers each disposed between the neighboring two depressions; and the rod member engaging with one of the plurality of depressions rolls over the rollers to allow the rod member to engage with other depressions.

5. The starter as in claim 1, wherein:

the abrasive force reducing means is a rolling sleeve covering the rod member; and the rolling sleeve rolls over projections each formed between neighboring two depressions to allow the rod member engaging with one of the plurality of depressions to engage with other depressions.

* * * * *